US006652602B2

(12) United States Patent
Yang et al.

(10) Patent No.: US 6,652,602 B2
(45) Date of Patent: Nov. 25, 2003

(54) COLOR DYEING SYSTEM FOR PLASTIC FILMS

(75) Inventors: Xiaoming Yang, San Diego, CA (US); Raymond B. Turner, San Diego, CA (US)

(73) Assignee: N.V. Bekaert S.A., Zwevegem (BE)

( * ) Notice: Subject to any disclaimer, the term of this patent is extended or adjusted under 35 U.S.C. 154(b) by 66 days.

(21) Appl. No.: 10/037,957

(22) Filed: Dec. 21, 2001

(65) Prior Publication Data

US 2003/0115689 A1 Jun. 26, 2003

(51) Int. Cl.[7] ..... D06P 3/52; D06P 1/613; D06P 1/92

(52) U.S. Cl. ..... 8/512; 8/444; 8/506; 8/522; 8/576; 8/922

(58) Field of Search ..... 8/444, 506, 512, 8/522, 576, 922

(56) References Cited

U.S. PATENT DOCUMENTS 4,047,889 A 9/1977 Hermes ..... 8/93
4,055,971 A 11/1977 Hermes ..... 68/9
4,115,054 A 9/1978 Hermes ..... 8/17
4,419,160 A 12/1983 Wang et al.
5,162,046 A 11/1992 Mercado ..... 8/512
5,338,318 A 8/1994 Mercado ..... 8/512
5,466,722 A 11/1995 Stoffer et al.
5,560,751 A * 10/1996 Hoshiyama et al.

* cited by examiner

*Primary Examiner*—Margaret Einsmann
(74) *Attorney, Agent, or Firm*—Greer, Burns & Crain, Ltd.

(57) ABSTRACT

A process for the continuous dyeing of plastic films, such as polyethylene terephthalate, is characterized by passing the film through a dye bath comprised of dye stuffs dissolved, suspended or dispersed in a liquid carrier comprised at least in part of a polymer, preferably a polyol, having at least one free hydroxyl group and a molecular weight within the range of from about 200 to about 600. The hydrogen bonding provided by the hydroxyl group, together with the high molecular weight and high boiling point of the polyol, mitigate against migration of the dye stuff out of the film, i.e., fading of the film, and impart long lasting color fastness to the film. Rapid diffusion of the dye bath into the film is enhanced by thermal and ultrasonic energization of the bath.

20 Claims, 1 Drawing Sheet

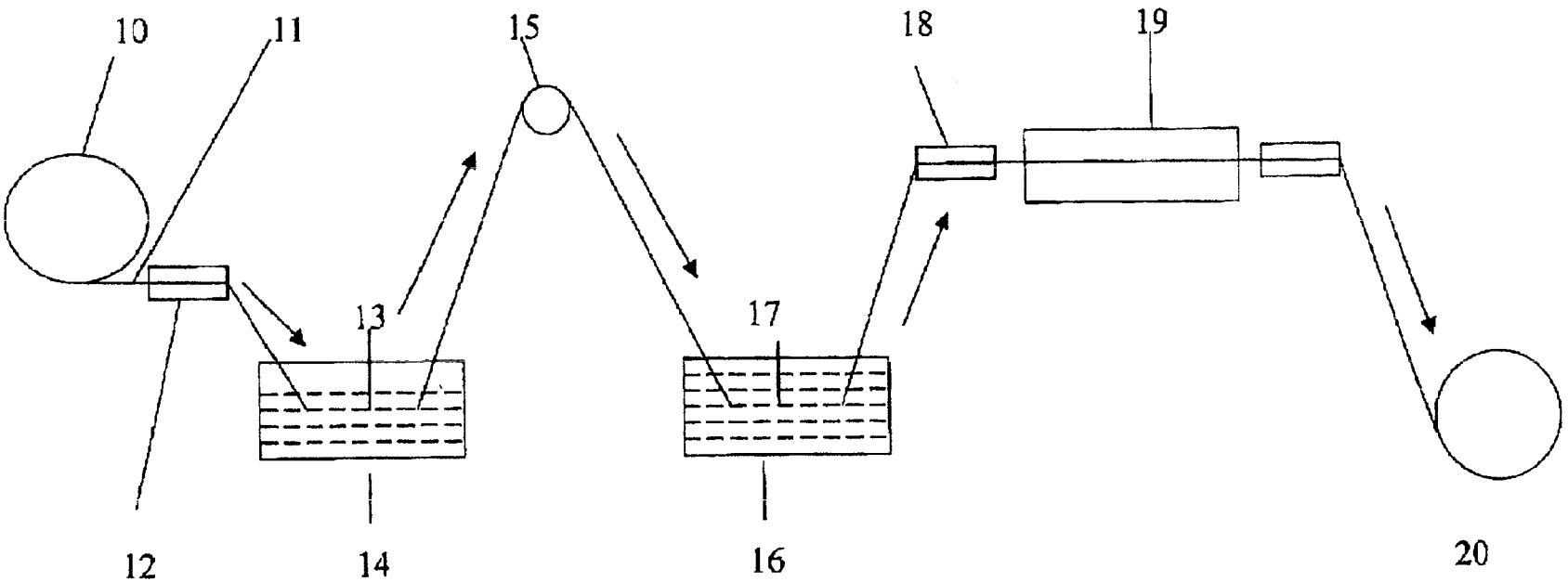
10
11
12
13
14
15
16
17
18
19
20

COLOR DYEING SYSTEM FOR PLASTIC FILMS

FIELD OF THE INVENTION

The present invention relates to color dyeing of plastic films, and more particularly, to a dip dye coloring system employing a solution of dye in a carrier comprised at least in part of a high molecular weight polyol and employing ultrasonic application of the dye solution to the film

BACKGROUND OF THE INVENTION

Plastic films, such as polyethylene terephthalate (PET), are in extensive commercial use for a variety of purposes. For many applications, it is desirable to have the film colored. At present, PET films may be colored by a solution dyeing system wherein the dyes are mixed into the melt before the film is extruded; a printing technique wherein color is laid on to the film, then set by heat; and a dip dyeing technique wherein the film is dipped into a vat containing a heated dye solution and is then washed and dried.

Extrusion dyeing yields excellent results, but it is impractical for small quantities or small production runs of the film, and colors cannot easily be changed between runs. The printing technique usually results in having color on one side only of the film, and it is difficult to get truly uniform color, i.e., level dyeing. Colored films produced by the dip dyeing technique tend to change color and/or fade quickly and have a short life span in the original color and/or color intensity.

In conventional dip dyeing of PET film, a continuous web of the film is immersed in and passed through a dye bath that is charged with the dye, a dye carrier, one or more wetting agents, and various processing aids or additives, at a temperature of 140° C. to 180° C. The web is then passed through a washing bath that is charged with solvents to wash excess dye and additives off the web. After washing, the colored film is passed through a drying oven and dried at a temperature of about 180° C.

Dye carriers previously proposed include various ethylene glycols, propylene glycol, the methyl-ethyl-mono- and di-ethers of such glycols and the esters of such glycols; and also glycerol triacetate (triacetin).

U.S. Pat. Nos. 4,047,889, 4,055,054, and 4,115,054 disclose a process for the continuous and waterless dyeing of textile and plastic materials in which the dyestuff is dissolved, suspended or dispersed in a high boiling solvent, such as glycol or glycol ether, for carrying out the dyeing step per se, after which the dyed textile or plastic material is subjected to a washing with a low boiling liquid such as methanol or ethanol or a chlorinated hydrocarbon solvent, and subsequently dried. The entire series of operations is carried out under non-aqueous or substantially non-aqueous conditions with substantially complete recovery and recycling of the used dye stuff, the used high-boiling solvent, and the used low-boiling wash liquid. The entire operation is conducted in a substantially completely closed cyclic system with essentially complete recovery and reuse of the treating liquids.

U.S. Pat. Nos. 5,162,046 and 5,338,318 disclose a method of dyeing PET film wherein the film is submerged in a dye bath of solvent dyes dissolved in a carrier consisting of glycerol triacetate, the dye bath being heated so the film is raised to the glass transition temperature of the film, and the dye and carrier are absorbed into the film. Excess dye and carrier are removed from the surface of the film by a washing bath, and the film is then heated to remove the carrier absorbed in the film without depreciating the dye stuff or the film.

The glycols and glycol-ethers employed as dye carriers pursuant to the above practices, i.e., as described in the first group of patents, are of low molecular weight, e.g. a molecular weight in the order of about 100 or less, to facilitate penetration of the dye bath into the film. However, there is little if any chemical reaction or molecular bonding between the dyes, the carrier and the film, with the result that the low molecular weight carrier and dyes quickly migrate out of the film, causing the film to change color and fade.

The glycerol triacetate employed as the carrier in the second group of patents is of higher molecular weight, e.g., about 218, but diffusion into the film is slow and of low intensity. Also, the triacetate does not have any hydroxol group available for chemical reaction or molecular bonding, with the same result as above, i.e., the carrier and the dyes migrate out of the film, causing the film to change color and fade.

U.S. Pat. No. 4,419,160, entitled Ultrasonic Dyeing of Thermoplastic Non-woven Fabric, discloses a process of applying liquid dye to the ultrasonically bonded point bonds of non-woven fabrics before or at the same time that the crossing points are bonded by ultrasonic energy, such that the energy is used both to bond the points and to drive and fix the dye in the bond points.

Graduate studies at North Carolina State University, Department of Textile Engineering, Chemistry and Science, have explored the use of ultrasonics in the wet processing (dyeing) of textiles.

Despite the foregoing, there remains a significant need for improvement in the color dyeing of plastic films.

OBJECTS OF THE INVENTION

A prime object of the present invention is to provide color-fast dip dyed plastic films.

Another object of the invention is to provide a method of dip-dying plastic films wherein the dye or dyes and dye carrier are chemically, mechanically and/or molecularly bonded to one another and the film for long lasting color fastness.

Yet another object of the invention is to provide a method of dip-dyeing plastic films wherein the dye carrier includes at least one constituent having high molecular weight and at least one free hydroxyl group, capable of mechanically and chemically bonding the dye solution or bath into the molecular structure of the film.

A further object of the invention is to provide a method of dip-dyeing plastic films wherein thermal and ultrasonic energy are utilized to hasten the dyeing process and to enhance the bonding of the dye in the film.

A still further object of the invention is to provide a method of dip-dyeing plastic films that is convenient and economical to practice and that produces economical yet exceedingly high quality dyed films.

SUMMARY OF THE INVENTION

In accordance with the invention, dip dyeing of plastic films is performed utilizing (1) a high molecular weight polyol as the dye carrier or as a constituent of the carrier and (2) heat and ultrasonic energy as mutual forces to drive the dyes and the dye carrier into the film.

Use of a high molecular weight polyol in or as a dye carrier provides a dye system based on molecular interactions, such as hydrogen bonds, fusion and miscibility, by and between the dye or dyes, the carrier or carriers and the film. Thus, the dyed film is color-fast.

Heat in the range of the glass transition temperature and near the melting point of the film, i.e., 100–180° C., causes the film to expand and permits the dye bath to enter into the film structure. Ultrasonic energization and excitation of the bath speeds the rate and degree of penetration of the dye bath into the film, especially the penetration of the high molecular weight polyol into the film. Both energy sources also contribute to molecular bonding of the polyol, the dye or dyes and the film.

Thus, the method is performed rapidly and economically and the resulting film has the prescribed color intensity and color fastness over a prolonged period of time.

The foregoing and other objects and advantages of the invention will become apparent to persons of reasonable skill in the art from the following detailed description, as considered in conjunction with the accompanying drawing.

BRIEF DESCRIPTION OF THE DRAWING

The single FIGURE of the drawing is a schematic illustration of a plastic film dip dyeing apparatus.

DETAILED DESCRIPTION OF PREFERRED EMBODIMENTS

The following is a detailed description of certain embodiments of the invention presently deemed by the inventors to be the best mode of carrying out their invention.

Referring to the drawing, a typical dip-dyeing apparatus comprises a take-off station 10 for a web 11 of plastic film in roll form, a take-off device 12 for pulling the web off the roll at a predetermined rate and advancing the web to a film immersion means 13 immersed in a container or tank 14 containing a web dyeing solution. After absorbing the web dyeing solution, the web is advanced upward to drain some of the excess dye solution off the surfaces of the web. The web is then turned over a roll 15 for travel downward to an immersion means 17 immersed in a tank 16 of wash solution for washing the remaining excess dye and dye carrier off the surfaces of the web. From the container 16, the web is directed by a guiding means 18 into a drying oven 19 and then to a take-up reel 20. The take-up reel 20 is driven in synchronism with the takeoff means and serves to pull the web through the two tanks and the oven and to wind the web into a storage reel or roll of dyed film.

In accordance with the present invention, the dyeing solution in the tank 14 comprises one or more dyes dissolved, dispersed or suspended in a carrier that is comprised of or includes a high molecular weight polyol; the solution in the tank is heated to a temperature at or near the glass transition temperature of the film; the transit time of the film through the solution is adjusted (a) to raise the temperature of the film to or near its glass transition temperature and (b) to provide a residence time of the film in the bath sufficient to impart to the film the desired color and color intensity; and the dyeing bath or solution is energized or excited by ultrasonic energy to enhance penetration of the dye bath or solution (especially the high molecular weight polyol) into the film.

The dye system takes into consideration the miscibility of the dyes, the carrier and the bath additives based on molecular interactions, hydrogen bonding interactions between the carrier and the dyes and the PET molecular chains, and the diffusion speed of the carrier and the dyes under ultrasonic excitation. The system provides excellent color pick-up speed and color penetration through fast diffusion, and high dye stability in the film through hydrogen bonding between the PET chains and the dyes.

The dye carrier may be comprised solely of a high molecular weight polyol having one or more free hydroxyl groups, or the carrier may be comprised of various blends of such high molecular weight polyols and other carrier materials, such for example as the ethylene glycols previously employed. The high molecular weight polyol in such blends will still form hydrogen bonds with both the PET and the dyes, and will also mitigate dye migration out of the film due to the high molecular weight and high boiling point of the polyol. Though the higher molecular weight of the polyol tends to reduce diffusion speed, ultrasonic energy will not only make up the diffusion speed, but will also enhance dye pick up.

The following formulations have been tested:

| Ingredient | Weight in Grams | Weight in Percent |
|---|---|---|
| 1. Dip Dye Formulation with Polymeric Carrier | | |
| Water | 40 grams | 16.5 |
| DOW Polyol 200 | 200 grams | 82.6 |
| Black dye | 2 grams | 0.40 |
| Yellow dye | 0.08 grams | 0.03 |
| Red dye | 0.05 grams | 0.02 |
| 2. Dip Dye Formulation with a Blend of Carriers | | |
| Water | 40 grams | 16.5 |
| Ethylene Glycol | 100 grams | 41.3 |
| DOW Polyol 200 | 100 grams | 41.3 |
| Black dye | 2 grams | 0.40 |
| Yellow dye | 0.08 grams | 0.03 |
| Red dye | 0.05 grams | 0.02 |

The DOW Polyol 200 polymeric carrier, which is available from Dow Chemical Co., has a molecular weight of 200. The ethylene glycol has a molecular weight of 92. The three dyes are available from Four Colors, Inc. The black dye is identified as KENX-SF.

The test procedure is as follows:

The dyes are mixed with the water and the carrier or carriers to make a dye liquor. The liquor is heated and mechanically agitated to obtain a dispersion and/or solution. The dye liquor is then filtered to remove any impurities or residues. The resultant dye liquor is heated to and maintained at the desired temperature, which is within the range of 100–180° C. An undyed sample of 0.50 mil thick PET film was submerged in the dye liquor for about five seconds and the sample was then rinsed with water and MEK to remove any dye liquor adhering to the surface of the film. The sample was then subjected to heat treatment by convection for five seconds at 120° C. to flash off or vaporize the entrapped residual carrier and water. Uniform charcoal colors were produced by both formulations. Tests were also conducted with the bath of dye liquor excited at dual ultrasonic frequencies of 80 khz and 110 khz. These tests successfully demonstrated that greater color intensity is obtained under ultrasonic energization, or conversely, that a given color intensity can be obtained in less time with ultrasonic energization than without.

The temperature range for practice of the process is generally in the range of the glass transition temperature of the PET film. The preferred range is from about 120° to about 180° C. If the thickness of the film is below one mil (0.001 inch), the temperature should be in the lower end of the range.

A suitable range for the molecular weight of the polyol is from about 200 to about 600. If the molecular weight is lower than about 200, dye migration and color fade is likely to occur. If the molecular weight is above 600, it would be very difficult to vaporize excess polyol out of the dyed film considering the 180° C. limitation on degradation of PET film. If a blend of polyol and an ethylene glycol is employed, the ratio of the blends of glycols and polyols should be in the range of from about 20:80 to about 80:20 by weight. The water in the above formulations enhances dissolution of the dye or dyes and can be within the range of from about 15% to about 25% by weight.

The dye stuffs employed are those conventional in the art for the dyeing of film. Various dye stuffs can be mixed or blended to create the desired colors. For light colors, the concentration of the dye in the solution may be in the range of from about 2 to about 40 grams of dye stuff per liter of carrier, and at a bath temperature of from 100° C. to 180° C., immersion or contact time may be within the range of from about two seconds to about ten seconds. For deeper colors, the concentration can be increased to a range of from about 40 to about 110 grams per liter of carrier and immersion or contact time can be from about five to about ninety seconds.

The temperature of the dye bath should be sufficient within the allotted time to raise the PET film to its glass transition temperature. In this range, the PET material expands to allow the dye bath to enter the material. Since the dye stuffs are in solution in the carrier, it will be understood that both the carrier and the dye stuff enter the PET film.

Use of ultrasound increases polymer swelling and the diffusion coefficient of dye into the polymer. In addition, ultrasound can increase the film/dye bath partition coefficient and enhance transport of the dye to the film by reducing boundary layer thickness and breaking up micelles and high molecular weight aggregates into uniform dispersions in the dye bath. Hence, the use of ultrasound in dyeing provides energy savings, reduced processing times and lower overall processing costs.

After treatment in the dye bath, the PET film is removed and allowed to drain and is then immersed in a washing bath. The washing bath preferably comprises a material that will dissolve the adhering excess solution of dye and carrier, but will not attack or degrade the PET film. The washing bath should be a low-boiling point liquid so it can be easily removed from the film. The alkane alcohols fit this description, and it has been found that ethanol yields excellent results. Methyl ethyl ketone (MEK) also yields good results.

After the film has been washed in the washing bath, the film is oven dried. Since the polymeric glycol is a plasticizer for PET, the presence of a trace of the carrier or carriers within the film will not significantly alter the physical properties of the film. Thus, most of the carrier or carriers should be removed from the film, but not necessarily 100% removed. It is contemplated that the final heat treatment in the oven will be carried out between 100° C. and 175° C. with an exposure time of from about 3 to about 30 seconds.

During the final heat treatment, there is little or no dye migration because the dye stuffs are hydrogen bonded with the PET film. Hence, the high quality of dyeing is not degraded by the final heat treatment.

It will be understood that, in order to change colors, it is only necessary to change the dye bath and the wash bath, so a complete color change can be done quickly and easily. As a result, very short production runs can be performed economically, using the method of the present invention.

The objects and advantages of the invention have thus been shown to be achieved in a convenient, economical, practical and facile manner.

While certain preferred embodiments of the invention have been herein described, it will be appreciated that various changes, rearrangements, and modifications may be made therein without departing from the scope of the invention, as defined by the appended claims.

What is claimed is:

1. In a process for color dyeing polyethylene terephthalate films wherein the film is dipped in a dye bath comprised of dye stuff dissolved, suspended or dispersed in a liquid carrier, the dipped film is washed and the washed film is dried, the step of dipping the film in a dye bath having a liquid carrier comprised at least in part of a polyol having at least one free hydroxyl group and a molecular weight of at least about 200.

2. A process as set forth in claim 1 wherein the polyol has a molecular weight within the range of from about 200 to about 600.

3. A process as set forth in claim 1 wherein the dye bath is comprised of about 75% to 85% by weight of the liquid carrier.

4. A process as set forth in claim 1 wherein the liquid carrier includes an ethylene glycol.

5. A process as set forth in claim 1 wherein the liquid carrier is comprised of the polyol and at least one ethylene glycol and the ratio of polyol to glycol is within the range of from about 80:20 to about 20:80.

6. A process as set forth in claim 5 wherein the liquid carrier is comprised of about 75–85% by weight of the polyol and glycol.

7. A process as set forth in claim 1 wherein the liquid carrier includes water.

8. A process as set forth in claim 1 wherein the liquid carrier includes from about 15% to about 25% by weight water.

9. A process as set forth in claim 1 wherein the liquid carrier is comprised of the polyol, at least one ethylene glycol and water.

10. A process as set forth in claim 9 wherein the liquid carrier is comprised of about 75–85% of polyol and glycol, and about 15–25% by weight of water.

11. A process as set forth in claim 1 including the step of ultrasonically energizing the dye bath while dipping the film therein.

12. A process as set forth in claim 11 including the step of ultrasonically energizing the dye bath at a plurality of frequencies.

13. A process of color dyeing plastic film comprising the steps of providing a web of polyethylene terephthalate film;

providing a dye bath comprised of dye stuffs dissolved, suspended or dispersed in a liquid carrier comprised at least in part of a polyol having at least one free hydroxyl group and a molecular weight of at least about 200;

heating the dye bath to about the glass transition temperature of the web of film;

passing the web of film through the dye bath with a dwell time in the bath such that the temperature of the film is maintained at about its glass transition temperature and such that the film absorbs dye stuff from the dye bath;

removing the film from the dye bath and draining excess dye bath from the surfaces of the film, and drying the film to remove excess carrier liquid from the film.

14. A process as set forth in claim 13 including the step of ultrasonically energizing the dye bath while passing the web of film through the bath.

15. A process as set forth in claim 13 wherein the concentration of dye stuff in the carrier is from about 2 to about 110 grams dye stuff per liter of carrier and the dwell time of the film in the bath is from about two seconds to about 90 seconds.

16. A process as set forth in claim 13 wherein the polyol has a molecular weight within the range of from about 200 to about 600.

17. A process as set forth in claim 13 wherein the dye bath is comprised of about 75–85% by weight of the liquid carrier.

18. A process as set forth in claim 13 wherein the liquid carrier is comprised of the polyol, at least one ethylene glycol and water.

19. A process as set forth in claim 18 wherein the liquid carrier is comprised of about 75–85% by weight of polyol and glycol and about 15–25% by weight of water.

20. A process of color dyeing polyethylene terephthalate films comprising the steps of providing a web of polyethylene terephthalate film;

providing a dye bath comprised of dye stuffs dissolved, suspended or dispersed in a liquid carrier comprised at least in part of a polyol having at least one free hydroxyl group and a molecular weight of at least about 200;

heating the dye bath to about the glass transition temperature of the film;

ultrasonically energizing the dye bath;

passing the web of film through the heated and ultrasonically energized dye bath with a dwell time in the bath such that the temperature of the film is maintained at about its glass transition temperature and such that the film absorbs dye stuff from the dye bath;

removing the film from the dye bath and draining excess dye bath from the surfaces of the film; and drying the film to remove excess carrier liquid from the film.

* * * * *